US008490589B2

(12) United States Patent
Arnold

(10) Patent No.: US 8,490,589 B2
(45) Date of Patent: Jul. 23, 2013

(54) ROTOR, IN PARTICULAR FOR A CAMSHAFT ADJUSTER, METHOD FOR PRODUCING A ROTOR AND DEVICE FOR ADJUSTING THE ANGLE OF ROTATION OF A CAMSHAFT RELATIVE TO A CRANKSHAFT OF AN ENGINE

(75) Inventor: Mario Arnold, Aurachtal (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 0 days.

(21) Appl. No.: 13/510,114

(22) PCT Filed: Nov. 10, 2010

(86) PCT No.: PCT/EP2010/067167

§ 371 (c)(1),
(2), (4) Date: May 16, 2012

(87) PCT Pub. No.: WO2011/061100

PCT Pub. Date: May 26, 2011

(65) Prior Publication Data

US 2012/0222638 A1 Sep. 6, 2012

(30) Foreign Application Priority Data

Nov. 17, 2009 (DE) ..... 10 2009 053 600

(51) Int. Cl.
*F01L 1/34* (2006.01)

(52) U.S. Cl.
USPC ..... 123/90.17; 123/90.15; 123/90.31

(58) Field of Classification Search
USPC ..... 123/90.15, 90.17, 90.31
See application file for complete search history.

(56) References Cited

U.S. PATENT DOCUMENTS 6,868,812 B2 * 3/2005 Saito et al. ..... 123/90.17

FOREIGN PATENT DOCUMENTS

| | | |
|---|---|---|
| DE | 19938596 | 2/2001 |
| DE | 102005026553 | 9/2006 |
| DE | 102006059656 | 7/2007 |
| DE | 102007038400 | 3/2008 |
| EP | 0801212 | 10/1997 |
| EP | 1568856 | 8/2005 |

* cited by examiner

*Primary Examiner* — Zelalem Eshete
(74) *Attorney, Agent, or Firm* — Volpe and Koenig, P.C.

(57) ABSTRACT

A rotor (10), in particular for a camshaft adjuster, comprises a rotor base body (8) that comprises a hub part having a central oil inlet (14). In addition, at least one vane (18) arranged in a radial manner on the hub part (12) and also oil channels (16) that extend through the hub part (12) on both sides of each vane (18) and are connected to the central oil inlet (14) in such a manner as to allow the flow of oil are provided in the hub part (12). The process of manufacturing the rotor base body (8) is considerably simplified as the rotor base body (8) is divided along a dividing plane (T), so that it comprises two base body parts (6).

15 Claims, 2 Drawing Sheets

ROTOR, IN PARTICULAR FOR A CAMSHAFT ADJUSTER, METHOD FOR PRODUCING A ROTOR AND DEVICE FOR ADJUSTING THE ANGLE OF ROTATION OF A CAMSHAFT RELATIVE TO A CRANKSHAFT OF AN ENGINE

FIELD OF THE INVENTION

The invention relates to a rotor, in particular for a camshaft adjuster, comprising a rotor base body that comprises a hub part having a central oil inlet, at least one vane arranged in a radial manner on the hub part and also oil channels that extend through the hub part on both sides of each vane and are connected to the central oil inlet in such a manner as to allow the flow of oil. A rotor of this type is known for example from DE 199 38 596 A1. The invention further relates to a method for manufacturing a rotor of this type and a device for adjusting the angle of rotation of a camshaft with respect to a crankshaft of an engine having a rotor of this type.

BACKGROUND

Camshafts are used in internal combustion engines to actuate the gas exchange valves. The cams of the camshafts usually bear against cam followers, for example bucket tappets, drag levers or valve rockers. If a camshaft is set in rotation, the cams act on the cam followers that in turn actuate the gas exchange valves. Both the opening duration and also the opening amplitude, but also the opening and closing instants of the gas exchange valves, are therefore fixed by the position and the shape of the cams.

The angular displacement of the camshaft in relation to a crankshaft in order to achieve optimized control times for various rotational speed and load states is called camshaft adjustment. One structural variant of a camshaft adjuster operates, for example, according to what is known as the swing motor principle. In so doing, a stator and a rotor are provided that lie coaxially and can be moved relative to one another. The stator and the rotor together form hydraulic chambers, referred to here simply as chambers. One chamber pair is delimited in each case by webs of the stator and is divided by a respective vane of the rotor into two chambers which act in opposite directions and the volumes of which are modified by a relative rotational movement of the rotor with respect to the stator in the opposite direction. In the maximum adjusting position, the respective vane bears against one of the edge-side webs of the stator. The relative rotational movement of the rotor takes place by an adjustment of the vane, as a hydraulic medium, such as oil, is introduced via channels into the chambers and urges the vane away. The adjustment of the rotor causes the camshaft attached to the rotor to move, for example, in the direction 'Early', i.e. towards an earlier opening instant of the gas exchange valves. The adjustment of the rotor in the opposite direction causes the camshaft to be moved with respect to the crankshaft in the direction 'Late', i.e. towards a later opening instant of the gas exchange valves. The hydraulic medium is conveyed from a central oil inlet via oil channels, which are arranged on both sides of the respective vane, into the respective chamber. The oil channels represent for example bores in the material of the rotor and this constitutes a costly embodiment.

SUMMARY

The object of the invention is to simplify the process of manufacturing a rotor.

The object is achieved in accordance with the invention by virtue of a rotor, in particular for a camshaft adjuster, comprising a rotor base body that comprises a hub part having a central oil inlet, at least one vane arranged in a radial manner on the hub part and also oil channels that extend through the hub part on both sides of each vane and are connected to the central oil inlet in such a manner as to allow the flow of oil, wherein the rotor base body is divided along a dividing plane and comprises two base body parts.

The invention is based on the idea that the process of manufacturing a rotor is optimized, as the rotor base body is assembled from at least two base body parts that are mutually fixedly connected in a dividing plane. It is also possible that more than only one dividing plane is provided, for example that the rotor base body is divided along two dividing planes, so that the rotor base body comprises overall three base body parts that are joined together. As a result of the multi-part embodiment of the rotor base body in an early manufacturing step, each of the base body parts has a relatively small volume and a simplified geometry, which produces a simpler manufacturing process. The rotor base body is conventionally embodied as a sintered body. In this case, initially a sintered body of pressed powder, in particular metal powder, is manufactured and subsequently sintered. By dividing the base body it is possible to achieve complex geometries of the rotor base body by shaping the individual base body parts accordingly in a simple manner without additional machining processes.

According to a preferred embodiment, hollow chambers are provided in the rotor base body. The hollow chambers provide a reduction in weight of the rotor base body, so that on one hand a high mass moment of inertia is avoided and on the other hand less material is required to manufacture the rotor base body. The hollow chambers are preferably embodied as enclosed hollow chambers inside the rotor base body.

With a view to providing a particularly stable embodiment of the rotor base body, the hollow chambers are preferably embodied in the hub part. In addition, the hub part generally comprises a larger volume than the vanes and as a consequence more space is available for embodying the hollow chambers. The hollow chambers are arranged, for example, symmetrically about an axis of rotation of the rotor base body.

A considerable reduction in weight of the rotor is achieved, as the surface area of the hollow chambers (perpendicular to an axis of rotation of the rotor) amounts in an expedient manner to approx. ⅓ to ⅔ of the surface area of the hub part. Preferably the depth of the hollow chambers extends in the direction of the rotational axis over the entire axial length of the rotor base body except for a thin wall that closes off the hollow chamber axially in the outwards direction.

According to a further preferred embodiment, the oil channels are arranged in the dividing plane. This means that when the rotor base body is in the separated state the oil channels are embodied, in particular as groove-shaped material cutouts, on the surface of at least one base body part, which surface forms the dividing plane. When the base body parts are joined together, the oil channels lie inside the rotor base body. An embodiment of oil channels of this type does not require a high expenditure with regard to the technology used and subsequent machining of the oil channels is not required. Preferably a material cutout is provided only in one of the base body parts for embodying a respective oil channel.

Preferably the rotor base body comprises an axis of rotation and the dividing plane lies in a perpendicular manner with respect to the axis of rotation. In particular, the embodiment of radially extending channels and also hollow chambers that likewise lie in the dividing plane is simplified by embodying the dividing plane in a perpendicular manner with respect to the axis of rotation.

According to a preferred variant, the dividing plane divides the rotor base body centrally and the base body parts form two halves of the rotor base body. This embodiment of the base body parts is particularly advantageous from the technical aspect of the manufacturing process, as both base body parts of the rotor body are manufactured using the same tool.

According to a further preferred variant, the two halves are embodied identically to each other. In so doing, it is necessary only to manufacture one type of base body part. Two base body parts of this type are placed one on top of the other mirror-inverted and joined together for the purpose of embodying a rotor base body.

Preferably precisely one oil channel respectively is allocated in each base body part to each vane. This embodiment of the base body parts is associated with a particularly small processing cost, as a single material cutout is provided for an oil channel per vane in the base body part. If two base body parts are joined together mirror-inverted, the oil channel embodied in the respective opposite-lying base body part is located on the other side of the vane. As a consequence, two oil channels to the respective chambers are provided one on each side of the vane.

The two halves are connected in a simple manner, in particular by virtue of a positive-locking connection. Preferably the two halves are mutually connected by means of spigots. Spigots of this type generally have a simple geometry and are particularly easy to manufacture. In particular, the spigots form an integral component of the base body parts and are embodied in one manufacturing step with the respective base body part. Each base body part is provided accordingly with a number of spigot receiving means that correspond to the number of spigots. If two base body parts of this type are placed one on top of the other mirror-inverted, then the spigots of one of the base body parts is inserted into the spigot receiving means of the respective opposite-lying base body part.

The rotor base body is embodied in an expedient manner as a sintered body.

The object is further achieved in accordance with the invention by virtue of a method for manufacturing a rotor according to any one of the preceding embodiments, in which at least two base body parts are manufactured for the rotor base body and said parts are mutually fixedly connected in a dividing plane. Preferably the base body parts are manufactured as two identical halves and subsequently joined together. The base body parts are sintered after they have been joined together, thus producing the rotor base body. The rotor base body is consequently manufactured in a sintering process. The base body parts are embodied in a first manufacturing step individually as so-called sintered bodies, in particular from metal powder pressed into the desired shape. The two halves are then joined together in a second manufacturing step to form a closed rotor base body provided in particular with the hollow chambers and sealed and hardened during the sintering process by means of heat treatment.

In accordance with a preferred alternative, the base body parts are also manufactured using casting technology and mutually connected by means, for example, of soldering, welding or adhering.

The object is furthermore achieved in accordance with the invention by virtue of a device for adjusting the angle of rotation of a camshaft with respect to a crankshaft of an engine, having a rotor according to any one of the preceding embodiments.

The advantages and the preferred embodiments described with regard to the rotor can be transferred as far as the meaning is concerned to the method and to the device for adjusting the angle of rotation, which for the sake of simplicity is described as a camshaft adjuster.

BRIEF DESCRIPTION OF THE DRAWINGS

An exemplary embodiment of the invention is explained in further detail with reference to a drawing, in which.

Parts in all the figures that correspond to each other and function in a like manner are provided with like reference numerals.

DETAILED DESCRIPTION OF THE PREFERRED EMBODIMENTS

Figure 1:
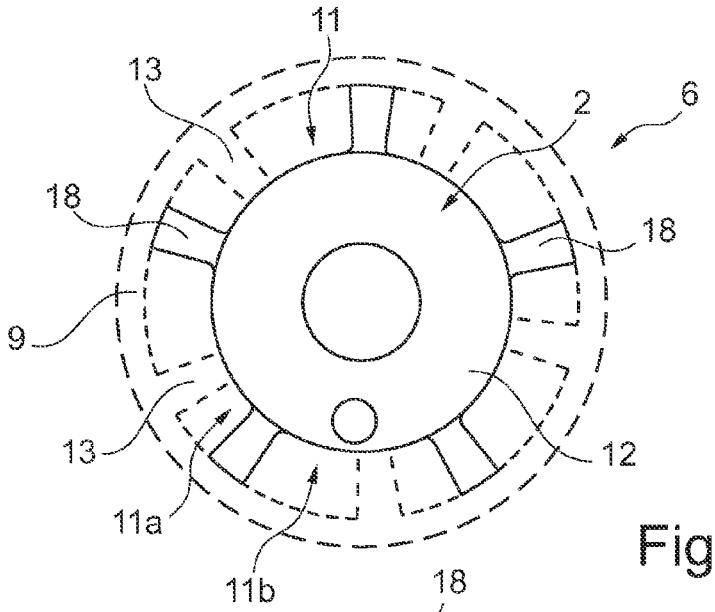
FIG. 1 shows a front view of an outer face of a half of a rotor base body.
Figure 2:
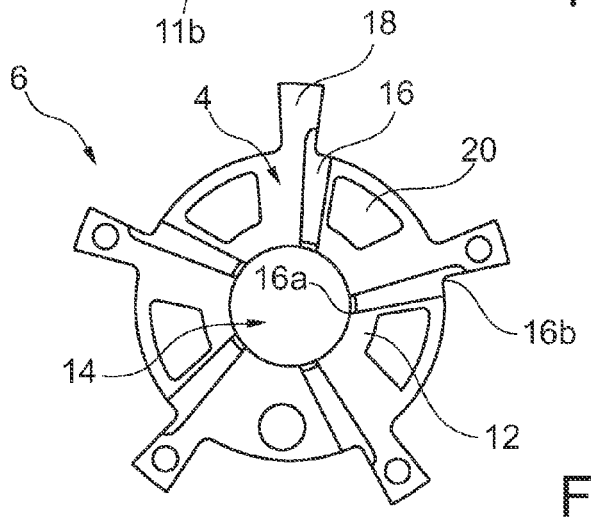
FIG. 2 shows a front view of an inner face of the half in accordance with FIG. 1.
Figure 3:
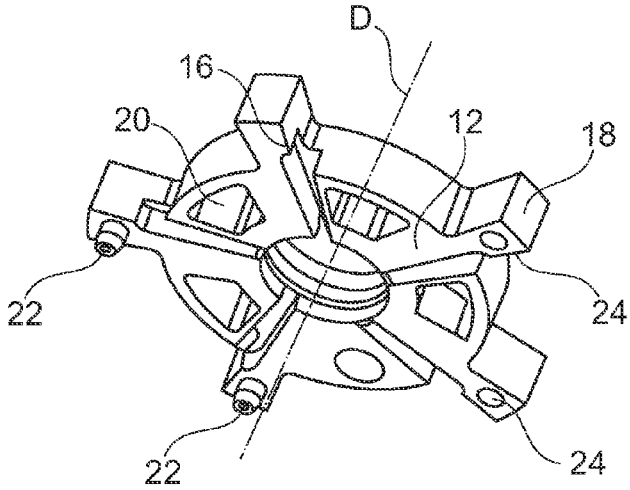
FIG. 3 shows a perspective illustration of the halves in accordance with FIGS. 1 and 2.
Figure 4:
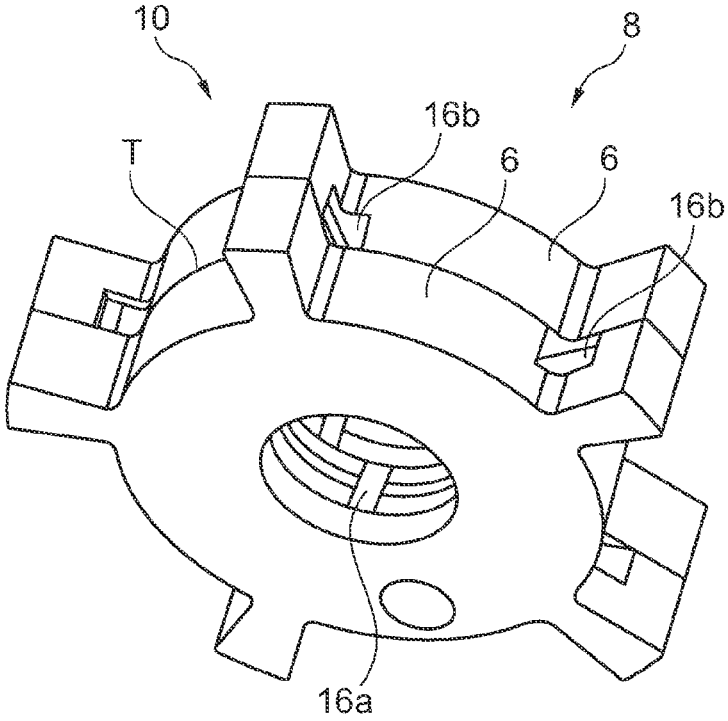
FIG. 4 shows a perspective illustration of a rotor.
Figure 5:
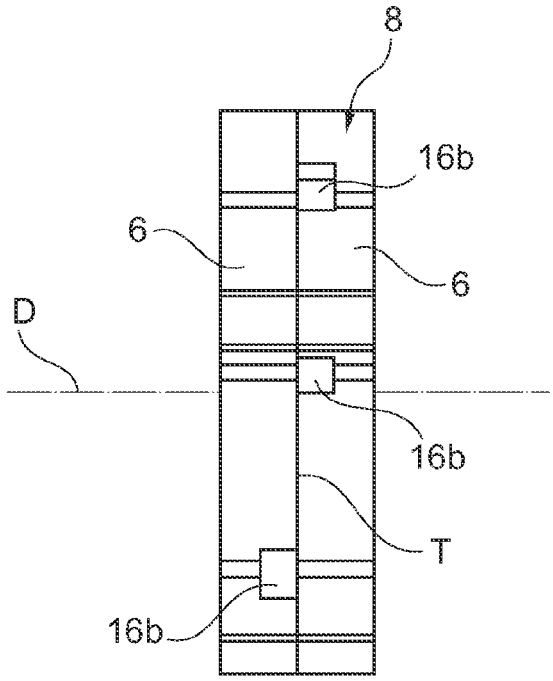
FIG. 5 shows a lateral view of the rotor in accordance with FIG. 4.

FIGS. 1 to 3 illustrate respectively an outer face 2 and an inner face 4 of a base body part 6, said inner face being remote from the outer face. The base body part 6 forms a half of a rotor base body 8, which is illustrated in FIGS. 4 and 5. The rotor base body 8 together with connection elements (not illustrated in detail) forms a rotor 10 that is part of a device for adjusting the angle of rotation of a camshaft (not illustrated in detail) with respect to a crankshaft of an engine. The rotor 10 is embodied in the illustrated exemplary embodiment 8 as an inner-side rotor and is encompassed by a stator 9 that is indicated by the broken contours in FIG. 1. Chambers 11 are embodied between the stator 9 and the rotor 10 and are delimited in the peripheral direction by radial webs 13 of the stator.

As is evident from FIGS. 2 and 3, each of the two base body parts 6 comprises a hub region 12 having a central, circular oil inlet 14. The oil inlet is arranged in a concentric manner with respect to an axis of rotation D of the base body part 6 and/or of the rotor base body 8. A hydraulic medium, in particular oil, introduced via the central oil inlet 14 is conveyed via radially extending oil channels 16 from the rotor base body 8 to the chambers 11 between the rotor 10 and the stator 9. In addition, radially arranged vanes 18 are provided on the hub part 12 at an equal mutually spaced disposition. Each of the vanes 18 is arranged in one of the chambers 11 in such a manner as to be able to pivot. The vane 18 divides the chamber 11 into two chambers 11*a*, 11*b* which act in opposite directions (cf. FIG. 1). The vane 18 and consequently the rotor 10 are moved relative to the stator 9, as oil is introduced into one of the chambers 11*a*, 11*b* which act in opposite directions.

Hollow chambers 20 are provided in the hub part 12 with a view to reducing the weight of the rotor base body 8 and said hollow chambers are formed by virtue of cutouts in the material on the inner face 4 of the base body part 6. The hollow chambers 20 have a substantially trapezium shape and are closed in an axial manner by virtue of a wall formed by the outer face 2. The surface area of the hollow chambers 20 amounts to approx. ⅓ to ⅔ of the surface area of the hub part 12 which is enclosed between two vanes 18.

The oil channels 16 comprise in each case an inlet 16*a* which is connected to the central oil inlet 14 in such a manner as to allow the flow of oil. An outlet 16*b* is provided on the peripheral side in the region of a vane 18. When the camshaft adjuster is in the assembled state, the oil channels 16 issue in each case into one of the chambers 11*a*, 11*b* between the rotor 10 and the stator 9, which chambers act in opposite directions and said one chamber is delimited on one side by virtue of one of the vanes 18. The number of oil channels 16 in each base body part 6 corresponds to the number of vanes 18. All the channels 16 are located on the same side of the respective vane 18, for example in the exemplary embodiment in accordance with FIGS. 2 and 3, the outlets 16*b* are always arranged on the right side of the vanes 18 and in particular extend somewhat in the vane 18.

The rotor base body 8 is produced by joining two base body parts 6, i.e. two halves, together and mutually connecting them. The two halves 6 are positioned mirror-inverted with respect to each other. The two halves 6 are placed one on top of the other, so that in the region of their inner faces 4 a dividing plane T is formed, which dividing plane divides the rotor base body 8 and extends in a perpendicular manner with respect to the axis of rotation D. The dividing plane T in the illustrated exemplary embodiment lies completely in one plane. Owing to the fact that the two base body parts 6 have an identical construction, the dividing plane T divides the rotor base body 8 centrally, wherein both the oil channels 16 and also the hollow chambers 20 lie in the dividing plane T.

In the rotor base body 8, the inner face 4 forms in the region of the hub part 12 of one of the base body parts 6 a wall of the oil channel 16 of the opposite-lying base body part. In addition, as a result of the halves 6 being positioned in a mirror-image manner, channels 16 are arranged in the region of each vane 18 on both sides of the vane 18 when the rotor base body 8 is joined together, wherein one of the oil channels 16 is allocated to one half 6 and the other oil channel 16 is allocated to the other half 6.

Spigots 22 that are formed in the vanes 18 are provided for mutually connecting the two base body parts 6 and said spigots are inserted into the spigot receiving means 24 on the opposite-lying base body part 6 to produce a positive locking connection. In the case of each base body part 6, the number of spigots 22 corresponds to the number of spigot receiving means 24. The spigots 22 and the spigot receiving means 24 are positioned in such a manner that when two identical base body parts 6 are lying opposite each other in a mirror-inverted manner, a spigot receiving means 24 is provided in the opposite-lying base body part 6 for each spigot 22.

The rotor base body 8 and/or the base body parts 6 are embodied in a sinter material during a sintering process. The individual base body parts 6 are first formed in particular from a metal powder using the same tool. In so doing, the hollow chambers 20 for reducing the weight, the oil channels 16 and further preferred supporting elements for a helical spring receiving device are integrated on each base body part 6. Two base body parts 6 of this type are joined together using their spigots 22 and sealed and hardened by virtue of heat treatment, so that in particular a one-piece rotor base body 8 is produced. The hollow chambers 20 and the oil channels 16 are enclosed inside the rotor base body 8 and the rotor base body 8 does not require any subsequent machining, for example to produce bores.

A rotor 10 that is embodied in this manner is suitable in particular as an inner rotor for camshaft adjusters, but can also be used in pumps or in further similar areas of application.

LIST OF REFERENCE NUMERALS

2 Outer face
4 Inner face
6 Base body part
8 Rotor base body
9 Stator
10 Rotor
11 Chamber
11*a*,11*b* Chambers which act in opposite directions
12 Hub part
13 Web
14 Oil inlet
16 Oil channel
18 Vane
20 Hollow chamber
22 Spigot
24 Spigot receiving means
D Axis of rotation
T Dividing plane

The invention claimed is:

1. A rotor for a camshaft adjuster, comprising a rotor base body that comprises a hub part having a central oil inlet, at least one vane arranged in a radial manner on the hub part and oil channels that extend through the hub part on both sides of each of the at least one vane and are connected to a central oil inlet to allow the flow of oil, the rotor base body is divided along a dividing plane (T) and comprises two base body parts.

2. The rotor as claimed in claim 1, wherein hollow chambers are provided in the rotor base body.

3. The rotor as claimed in claim 2, wherein the hollow chambers are embodied in the hub part.

4. The rotor as claimed in claim 3, wherein a surface area of the hollow chambers amounts to approx. ⅓ to ⅔ of a surface area of the hub part between two of the vanes.

5. The rotor as claimed in claim 1, wherein the oil channels are arranged in the dividing plane (T).

6. The rotor as claimed in claim 1, wherein the rotor base body comprises an axis of rotation (D) and the dividing plane (T) lies perpendicular to the axis of rotation (D).

7. The rotor as claimed in claim 1, wherein the dividing plane (T) divides the rotor base body centrally and the base body parts form two halves of the rotor base body.

8. The rotor as claimed in claim 7, wherein the two halves are identical to each other.

9. The rotor as claimed in claim 1, wherein one of the oil channels respectively is allocated in each of the base body parts to each of the vanes.

10. The rotor as claimed in claim 1, wherein the base body parts are mutually connected by spigots.

11. The rotor as claimed in claim 1, wherein the rotor base body is a sintered body.

12. A method for manufacturing a rotor as claimed in claim 1, wherein at least two of the base body parts are manufactured for the rotor base body and mutually fixedly connected.

13. The method as claimed in claim 12, wherein the base body parts are manufactured as two identical halves and are subsequently joined together.

14. The method as claimed in claim 12, wherein the base body parts are first embodied as sintered bodies, subsequently joined together and finally sintered.

15. A device for adjusting the angle of rotation of a camshaft with respect to a crankshaft of an engine, having a rotor as claimed in claim 1.

* * * * *